US007203329B2

(12) United States Patent
Alexander et al.

(10) Patent No.: US 7,203,329 B2
(45) Date of Patent: Apr. 10, 2007

(54) AUDIO SPEAKER SYSTEM EMPLOYING AN AXI-SYMMETRICAL HORN WITH WIDE DISPERSION ANGLE CHARACTERISTICS OVER AN EXTENDED FREQUENCY RANGE

(75) Inventors: Eric J. Alexander, Orem, UT (US); David Bushnell Staley, Park City, UT (US); Clayton C. Shaw, Park City, UT (US)

(73) Assignee: SoundTube Entertainment, Inc., Park City, UT (US)

( * ) Notice: Subject to any disclaimer, the term of this patent is extended or adjusted under 35 U.S.C. 154(b) by 319 days.

(21) Appl. No.: 10/776,708

(22) Filed: Feb. 11, 2004

(65) Prior Publication Data

US 2005/0175207 A1 Aug. 11, 2005

(51) Int. Cl.
*H04R 1/02* (2006.01)
*H04R 7/00* (2006.01)

(52) U.S. Cl. ..... 381/340; 181/159

(58) Field of Classification Search ..... 181/152, 181/159, 259, 192; 381/99, 182, 340, 341, 381/342, 343, 349, 351, 353, 423
See application file for complete search history.

(56) References Cited

U.S. PATENT DOCUMENTS

| | | | | |
|---|---|---|---|---|
| 3,867,586 | A * | 2/1975 | Maekawa et al. | 381/340 |
| 3,930,561 | A * | 1/1976 | Klayman | 181/192 |
| 4,310,065 | A * | 1/1982 | Kayman | 181/159 |
| 4,348,549 | A | 9/1982 | Berlant | 179/1 |
| 5,306,880 | A | 4/1994 | Coziar et al. | 181/149 |
| 5,602,930 | A | 2/1997 | Walton | 381/192 |
| 5,673,329 | A | 9/1997 | Wiener | 381/160 |
| 5,701,358 | A * | 12/1997 | Larsen et al. | 381/423 |
| 5,742,696 | A | 4/1998 | Walton | 381/156 |
| 5,750,943 | A | 5/1998 | Heinz | 181/152 |
| 5,894,524 | A | 4/1999 | Kotsatos et al. | 381/397 |
| 6,002,780 | A * | 12/1999 | Espiritu | 381/182 |
| 6,116,373 | A * | 9/2000 | Dodd | 181/152 |

(Continued)

FOREIGN PATENT DOCUMENTS

WO PCT/US98/14915 * 7/1998

OTHER PUBLICATIONS

Supplemental Technical Information for Model THIEL SCS3; Coherent Source Loudspeaker.

(Continued)

*Primary Examiner*—Sinh Tran
*Assistant Examiner*—Brian Ensey
(74) *Attorney, Agent, or Firm*—Gordon & Jacobson, P.C.

(57) ABSTRACT

A speaker system includes a speaker driver loaded by a horn waveguide. The speaker driver reproduces sound within an extended frequency range that includes a high frequency band between 8 kHz and 11 kHz. In the preferred embodiment, the extended frequency range includes a wide frequency band between 2 kHz and 11 kHz (and most preferably including the frequency band between 800 Hz and 11 kHz). The horn waveguide has an axi-symmetrical waveguide surface that provides uniform polar dispersion at dispersion angles greater than 90 degrees for sound within the extended frequency range. The waveguide surface preferably has an annular cross section with a radial dimension that increases curvilinearly from its throat to its mouth, such as a tractroid surface.

31 Claims, 16 Drawing Sheets

U.S. PATENT DOCUMENTS

| | | | | |
|---|---|---|---|---|
| 6,574,344 | B1 | 6/2003 | Wiener et al. | 381/343 |
| 6,862,360 | B2 * | 3/2005 | Tsai | 381/351 |
| 2003/0002694 | A1 * | 1/2003 | Thiele | 381/99 |

OTHER PUBLICATIONS

"Ultra-High Frequency Transducer 2404H" Specifications JBL; Oct. 1996.

"The Quadratic-Throad Waveguide"; a white paper on an invention by Charles E. Hughes; Peavey Electronics Corporation; by John Murray; 2000.

"Designing your own horn"; Horn Design.htm; melhuish.org.

"Tractroid" "Pseudosphere"; Mathworld.wolfram.com; Eric W. Weisstein; 1999-2003.

"White Papers: Material—Part III"; Avantgarde White Papers; www.avantgarde-usa.com; 2003-3004.

"Horn Design"; Idsg.snippets.org; Sep. 30, 2003.

"The Limitations of Wide Dispersion"; Atlas Sound, Ennis, Texas; 2001.

"Two-Way 12" Complex Conic Loudspeaker Systems; Renkus-Heinz; TRC121K Series.

"On the Specification of Moving-Coil Drivers for Low-Frequency Horn-Loaded Loudspeakers"; AES An Audio Engineering Society Preprint; by W. Marshall Leach, Jr.; presented at the 61st Convention Nov. 3-6, 1978, New York.

"Constant Directivity Sound Reinforcement"; Horn Technology; by Clifford Pereira; www.studio-systems.com; 1998.

"Fussion 3000"; Mackie; 3-Way Active Speaker System; 1999-2000.

"Speakers: Coverage Patterns"; Huisinga and Olsen Publishing; www.soundinstitute.com; 2003.

"Speakers"; www.uwosh.edu; Oct. 17, 2003.

"Produce Music with Thousands of Loops and Effects"; The Pro Audio Network; Digital Pro Sound; 2000.

"Horn Loudspeakers, How & Why"; by Holger Fromme; AvantGarde; 1998.

"Sound System Design Reference Manual"; JBL Professional; 1999.

* cited by examiner

1kHz

3kHz

4kHz

5kHz

6kHz

8kHz

10kHz

AUDIO SPEAKER SYSTEM EMPLOYING AN AXI-SYMMETRICAL HORN WITH WIDE DISPERSION ANGLE CHARACTERISTICS OVER AN EXTENDED FREQUENCY RANGE

BACKGROUND OF THE INVENTION

1. Field of the Invention

This invention relates broadly to audio speaker systems. More particularly, this invention relates to horn-type audio speaker systems.

2. State of the Art

Loudspeaker systems typically employ one or more of the following speaker elements: i) a sub-woofer that reproduces extremely low frequencies from about 20 Hz to 100 Hz; ii) a woofer that reproduces low frequencies from about 100 Hz to 500 Hz; iii) a mid-range speaker that reproduces frequencies from about 500 Hz to 6 kHz; and iv) a tweeter that reproduces high frequencies from about 6 kHz to 11–12 kHz (and possibly to 20 kHz). In such systems, cross-over circuitry delivers the appropriate frequency range to the separate speakers. There are two ways that the cross-over circuitry can be connected to the speaker system. In low and medium power applications, the cross-over circuitry is connected after the amplifier. In such configurations, the cross-over circuitry is typically disposed within the speaker cabinet. For high power applications, the cross-over circuitry is connected before the amplifier.

Sub-woofers, woofers and mid-range speakers typically emit sound in a highly dispersed manner. In contrast, tweeters typically emit sound in a highly directional manner. Thus, the dispersion pattern of the tweeter (which is the extent to which the tweeter yields acoustic radiation over a given area) is of particular importance in designing a speaker which has wider dispersion overall. There are several different types of tweeters including cone tweeters, dome tweeters, and horn tweeters.

Cone tweeters utilize a shallow cone surface with a sound producing diagram at its apex. Cone tweeters are efficient and most economical, and typically provide a narrow dispersion pattern.

Dome tweeters utilize a dome diaphragm to produce sound. The dome diaphragm is typically made of light hard metal (such as titanium), rigid plastic compounds, or soft silk-like material. Dome tweeters are efficient, yet typically provide narrow dispersion patterns for frequency components above 10 kHz.

Horn tweeters utilize a horn surface (which is typically curvilinear or exponential in nature) with a relatively small sound-producing element at its apex. Typically, horn tweeters are designed to provide a narrow dispersion pattern with a dispersion angle between 60 and 90 degrees for the high frequency audio signal components supplied thereto by the crossover-circuitry.

A wide dispersion pattern is desirable in some acoustic applications, such as distributed audio installations that require many loudspeakers for the desired acoustic coverage of the listening space. In such applications, the wide dispersion pattern reduces the number of speakers required to cover the listening area, and thus reduces costs. As described above, conventional tweeter designs are limited in their dispersion pattern (generally less than 90 degrees) for high frequency audio signal components, and thus are unsuitable for use in these applications. Thus, there remains a need in the art to provide audio speaker components that have wide angle dispersion characteristics for high frequency signal components and thus are suitable for use in acoustic applications requiring wide coverage such as distributed audio installations.

Moreover, it is desirous in many of these applications that the speaker components reproduce frequencies generally supported by a mid-range speaker (typically below 6 kHz down to 500 Hz). This extended frequency range also reduces the number of speakers required to cover the listening area and reduces costs. As described above, conventional tweeter designs support only high frequency components and thus fail to provide the benefits of an extended frequency range. Therefore, there remains a need in the art to provide audio speaker components that have wide angle dispersion characteristics over an extended frequency range.

Finally, it is desirous in many of these applications that the speaker provide a uniform dispersion pattern (typically referred to as "constant beamwidth" or "constant directivity") with respect to the area covered by the speaker. This feature simplifies the layout and design of the loudspeakers of the system in order to provide uniform coverage over the intended listening area. However, typical "constant beamwidth" horn tweeters are limited in their dispersion pattern (generally less than 90 degrees), and thus are disadvantageous in these applications. Therefore, there remains a need in the art to provide audio speaker elements that have uniform dispersion characteristics suitable for such wide coverage acoustic applications.

SUMMARY OF THE INVENTION

It is therefore an object of the invention to provide an audio speaker system which has a wide dispersion pattern for high frequency sound components.

It is another object of the invention to provide an audio speaker system which has a wide dispersion pattern for a broad frequency spectrum of sound.

It is a further object of the invention to an audio speaker system which has a uniform dispersion pattern for a broad frequency spectrum of sound.

In accord with these objects which will be discussed in detail below, the audio speaker system of the present invention includes a speaker driver operably coupled to a horn waveguide. The speaker driver reproduces sound within an extended frequency range that includes a high frequency band between 8 kHz and 11 kHz. In the preferred embodiment, the extended frequency range includes a wide frequency band between 2 kHz and 11 kHz (and most preferably includes the ultra-wide frequency band between 800 Hz and 11 kHz). The horn waveguide has an axi-symmetrical waveguide surface that provides for uniform polar dispersion at dispersion angles greater than 90 degrees for sound within the extended frequency range. The waveguide surface preferably has an annular cross section with a radial dimension that increases curvilinearly from its throat to its mouth.

According to one embodiment, the waveguide surface of the horn is a tractroid surface.

According to another embodiment, the waveguide surface of the horn is exponential in nature.

According to a preferred embodiment of the invention, the critical parameters of the horn (throat area, mouth area, length) are adapted to provide a frequency response which encompasses a substantial part of the extended frequency range supported by the speaker driver.

In another aspect of the present invention, an audio speaker system employs an annular gasket that separates the sound reproducing membrane of a speaker driver with a horn waveguide. The annular gasket is disposed in an area outside of and adjacent to the throat of the horn waveguide. The annular gasket is preferably realized from closed cell foam or other compliant acoustically-absorbable material. The gasket minimizes the volume of the compression chamber that the sound reproducing membrane is compressing, thus leading to less frequency cancellation (which leads to improved frequency response of the speaker driver).

Additional objects and advantages of the invention will become apparent to those skilled in the art upon reference to the detailed description taken in conjunction with the provided figures.

DETAILED DESCRIPTION OF THE PREFERRED EMBODIMENTS

Figure 1A:
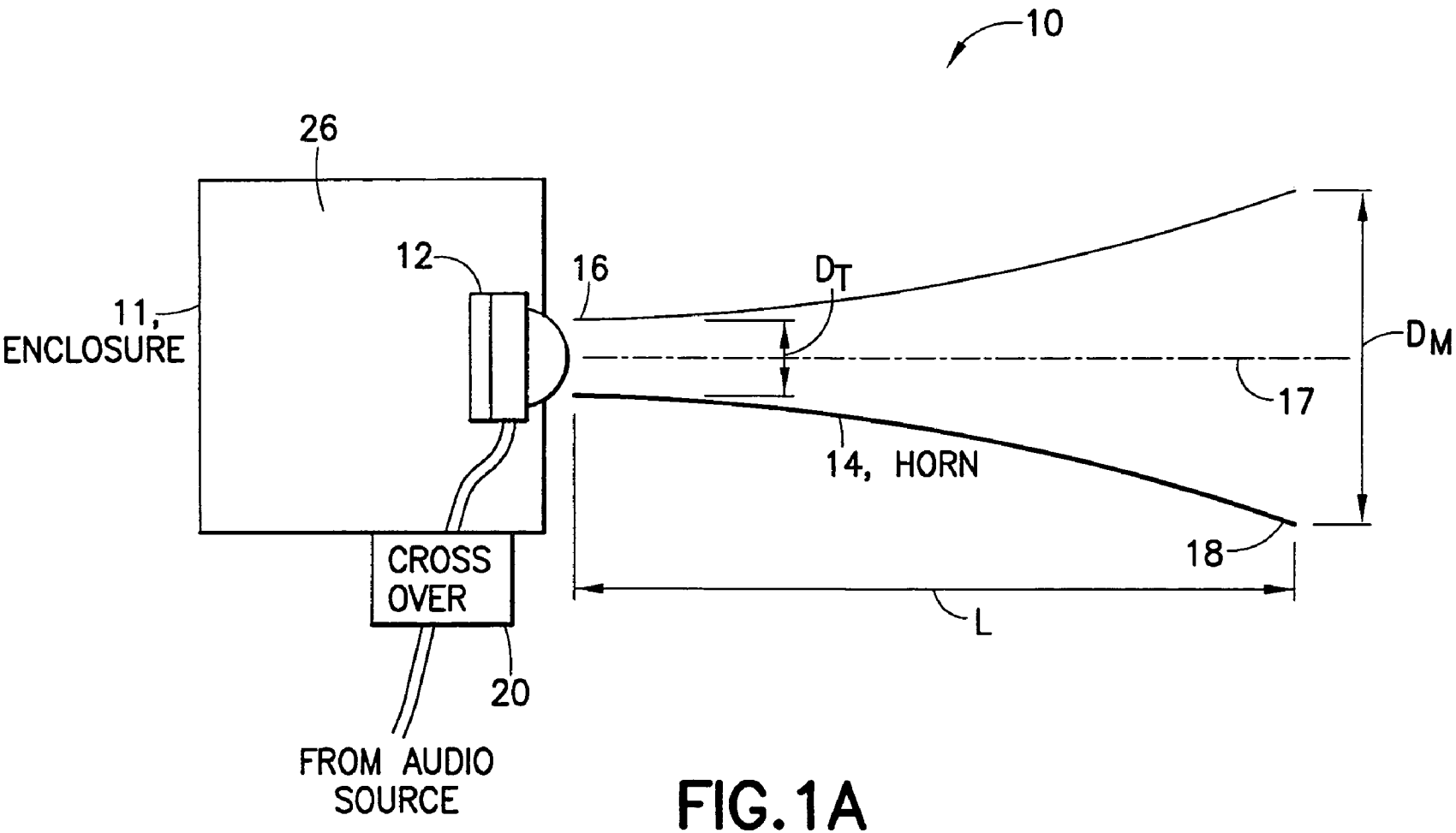
FIG. 1A is a functional block diagram illustrating the components of a horn-loaded speaker device in accordance with the present invention.

Turning now to FIG. 1A, the audio speaker system 10 in accordance with the present invention generally includes an enclosure 11 having a speaker driver 12 (sometimes referred to as a "motor") mounted therein. The speaker driver 12 includes a sound reproducing membrane that is actuated by a voice coil and magnet assembly as is well known in the audio speaker arts. Preferably, the sound reproducing membrane has a hemispherical-dome shape formed from a stiff thin material (typically metal or hard plastic) as is well known. A waveguide (horn) 14 is disposed adjacent the speaker driver 12. The horn 14 includes a throat 16 disposed adjacent the sound reproducing membrane of the speaker driver 12. The horn 14 extends along a central axis 17 to a mouth 18 disposed opposite the throat 16. The horn 14 directs the sound waves produced by the sound reproducing membrane of the speaker driver 12 out the mouth 18. An in-line phase plug (not shown) may be disposed in the vicinity of the throat 16 as is well known in the audio speaker arts. The in-line phase plug directs and focuses acoustic energy at the sound producing membrane of the speaker driver 12.

The speaker driver 12 is preferably a high fidelity speaker driver providing a 13 relatively flat response (e.g., +/−3 dB) throughout a relatively large frequency range (for example, between 800 Hz and 15 kHz). Cross-over filter circuitry 20, which is preferably integral to the enclosure 11, is operably coupled between an audio signal source (e.g., amplifier) and the speaker driver 12. Preferably, the cross-over filter circuitry 20 provides a high pass filter with a cut-off frequency that matches the lower end of the frequency range (for example, 800 Hz) supported by the speaker driver 12.

Figure 1B:
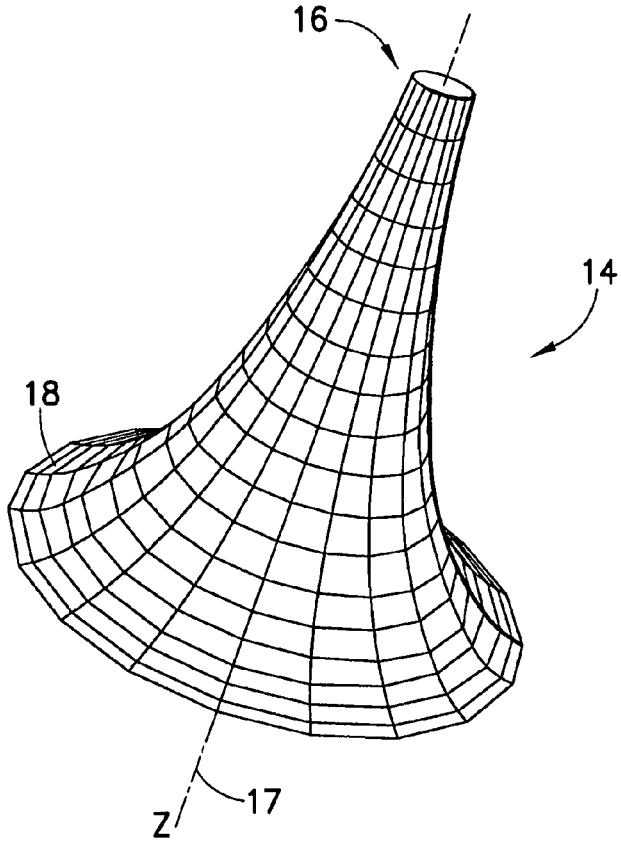
FIGS. 1B and 1C are views of a tractroid surface, which is suitable for realizing the waveguide surface of the horn waveguide of FIG. 1A.
Figure 1C:
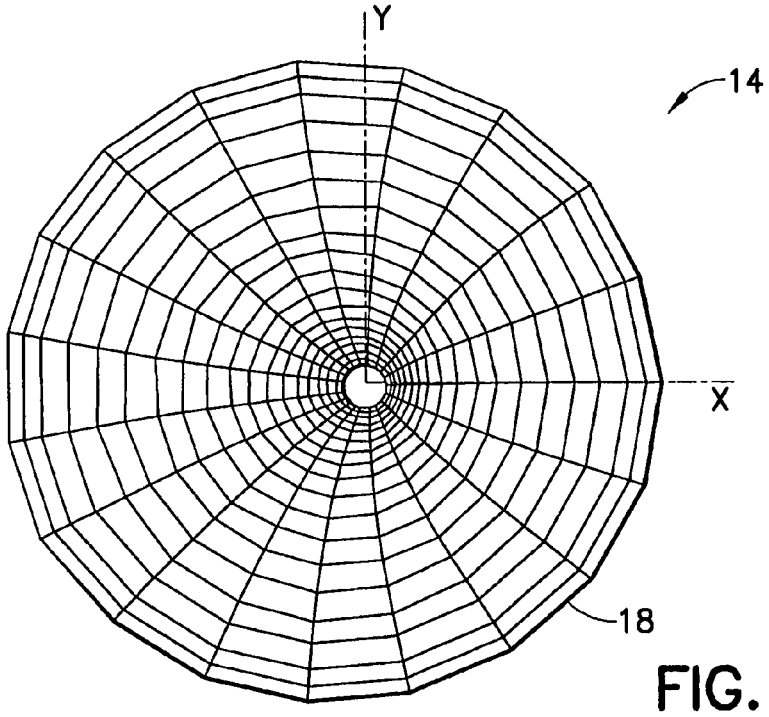

The horn 14 (or a portion thereof) defines a waveguide surface having an annular cross-section with a radial dimension that increases curvilinearly from the throat 16 to the mouth 18 as shown in FIGS. 1B and 1C. The waveguide surface is axi-symmetrical (i.e., symmetrical about the central axis 17) as shown. Preferably, the waveguide surface is a tractroid surface which is defined by revolving a tractrix surface around the central axis 17. This tractroid surface can be represented by the following parametric equations (in Cartesian space):

$$x=\sec h(u)\times\cos(v)$$

$$y=\sec h(u)\times\sin(v)$$

$$z=(u)-\tan h(u)$$

where the z-axis corresponds to the central axis, and the x and y axes are orthogonal to the z-axis as shown.

Alternatively, the waveguide surface of the horn 14 may be "exponential" in nature (i.e., where the horn length is exponentially related to the area of the horn mouth) or any other curvilinear surface with a smooth flare rate. The expression for such an "exponential" waveguide surface is $S=S_1e^{mx}$, where 'S' is the area of the horn mouth, '$S_1$' is the area of the horn throat, 'm' is the flare constant of the horn waveguide surface, and 'x' is the length of the horn waveguide surface.

The frequency response (e.g., the low cutoff frequency and high cutoff frequency) of the horn 14 is dependent upon the area of the throat 16 (which is governed by the diameter of the throat $D_T$), the area of the mouth 18 (which is governed by the diameter of the mouth $D_M$), and the length L of the horn as well as other parameters as is well known in the audio speaker arts. In the preferred embodiment of the present invention, these parameters are adapted to provide a frequency response between 800 Hz and 11 kHz, which encompasses a substantial part of the frequency range between 800 Hz and 15 kHz supported by the speaker driver 12.

Figure 2A:
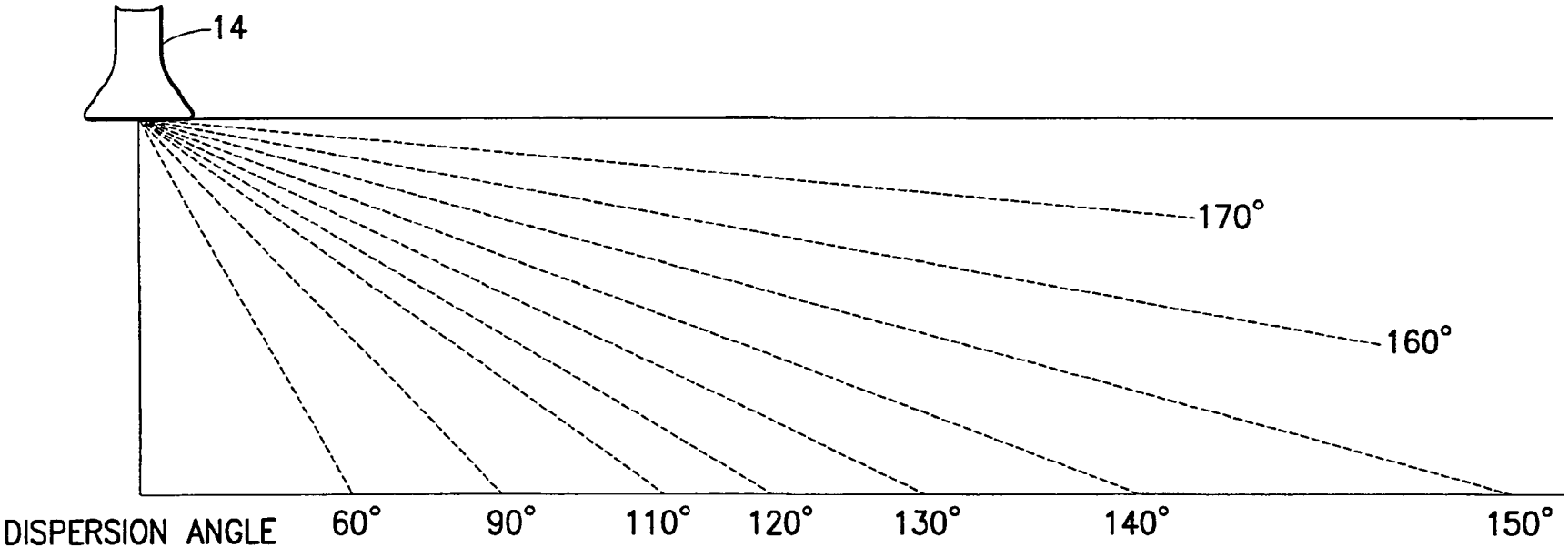
FIG. 2A is a diagram illustrating a wide range of dispersion angles.
Figure 2B:
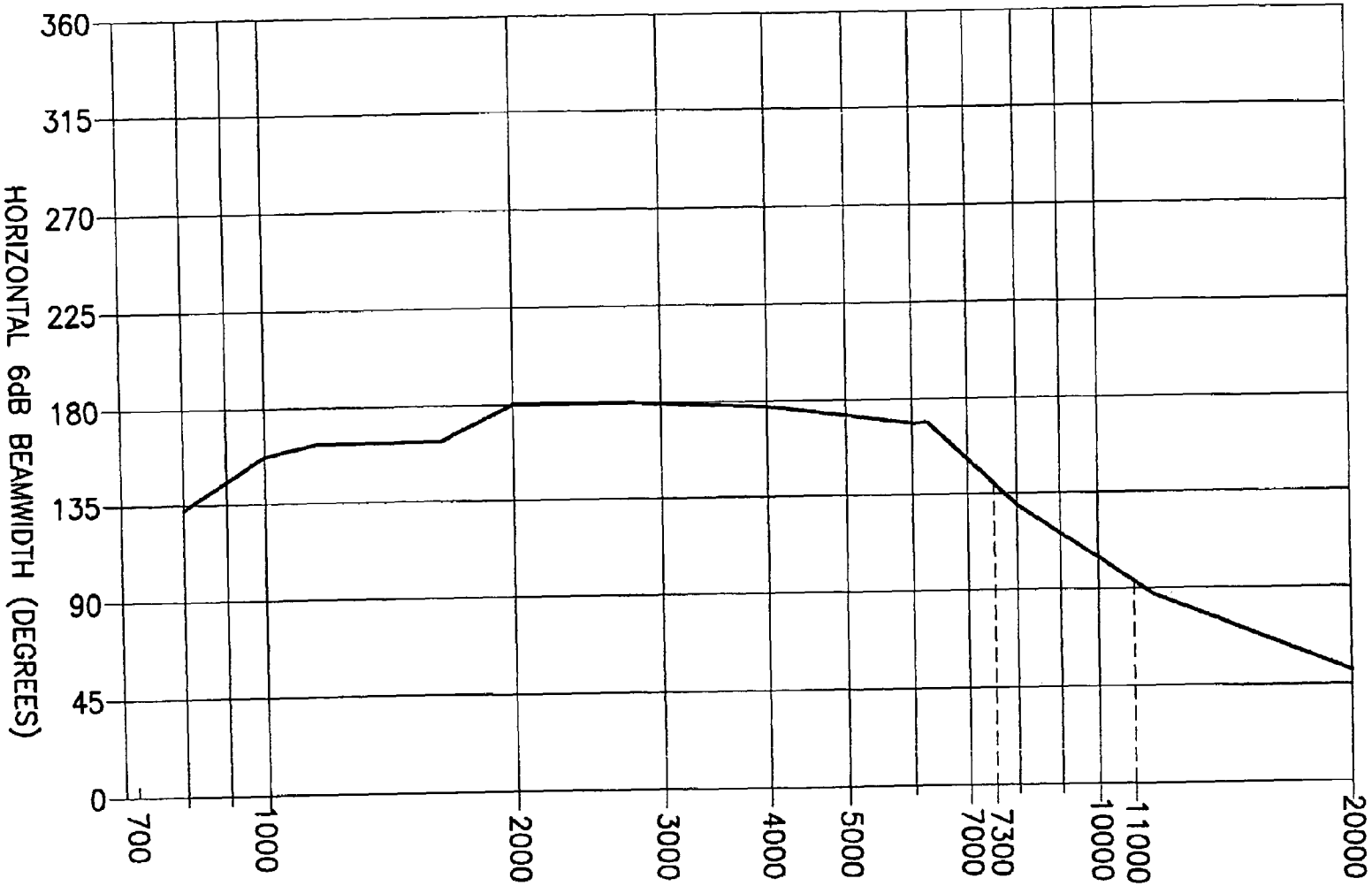
FIG. 2B is a plot characterizing the horizontal 6 dB beamwidth of a horn-loaded speaker device in accordance with the present invention.

The sound waves produced by the speaker driver 12 are emitted from the horn 14 in a dispersion pattern that is characterized by a dispersion angle, which is the angle at which the sound level is reduced by 6 dB as compared to the on-axis sound level. An array of dispersion angles are shown in FIG. 2A. In the preferred embodiment of the present invention, the axi-symmetrical waveguide surface of the horn 14 provides uniform polar dispersion of sound at dispersion angles greater than 90 degrees (referred to herein as a "wide dispersion angle" or "wide dispersion") over a relatively large frequency range (for example, between 800 Hz and 11 kHz) of sound. Such wide dispersion characteristics of the sound levels along the horizontal x-axis of the horn 14 is shown in the horizontal beamwidth curve of FIG. 2B. In this diagram, for the frequency range between 800 Hz and 7.3 kHz, the dispersion angle is greater than 135 degrees. For the frequency range between 7.3 kHz and 11 kHz, the dispersion angle is between 135 degrees and 90 degrees. Note that for frequencies above 11 kHz, the dispersion angle narrows to values below 90 degrees. The horn 14 provides similar dispersion characteristics for the sound levels along its vertical y-axis. In this manner, the axi-symmetrical waveguide surface of the horn 14 provides for uniform polar dispersion of sound for the particular frequencies within the extended frequency band (e.g., between 800 Hz and 11 kHz). In other words, the sound waves of a particular frequency within the extended frequency band (e.g., between 800 Hz and 11 kHz) are uniformly dispersed in both the x-direction and y-direction as the sound waves propagate from the mouth 18 along the central axis (i.e., the z-direction). Preferably, the extended frequency band (e.g., between 800 kHz and 11 kHz) encompasses a substantial part of the frequency range (e.g., between 800 Hz and 15 kHz) supported by the speaker driver 12.

Figure 3:
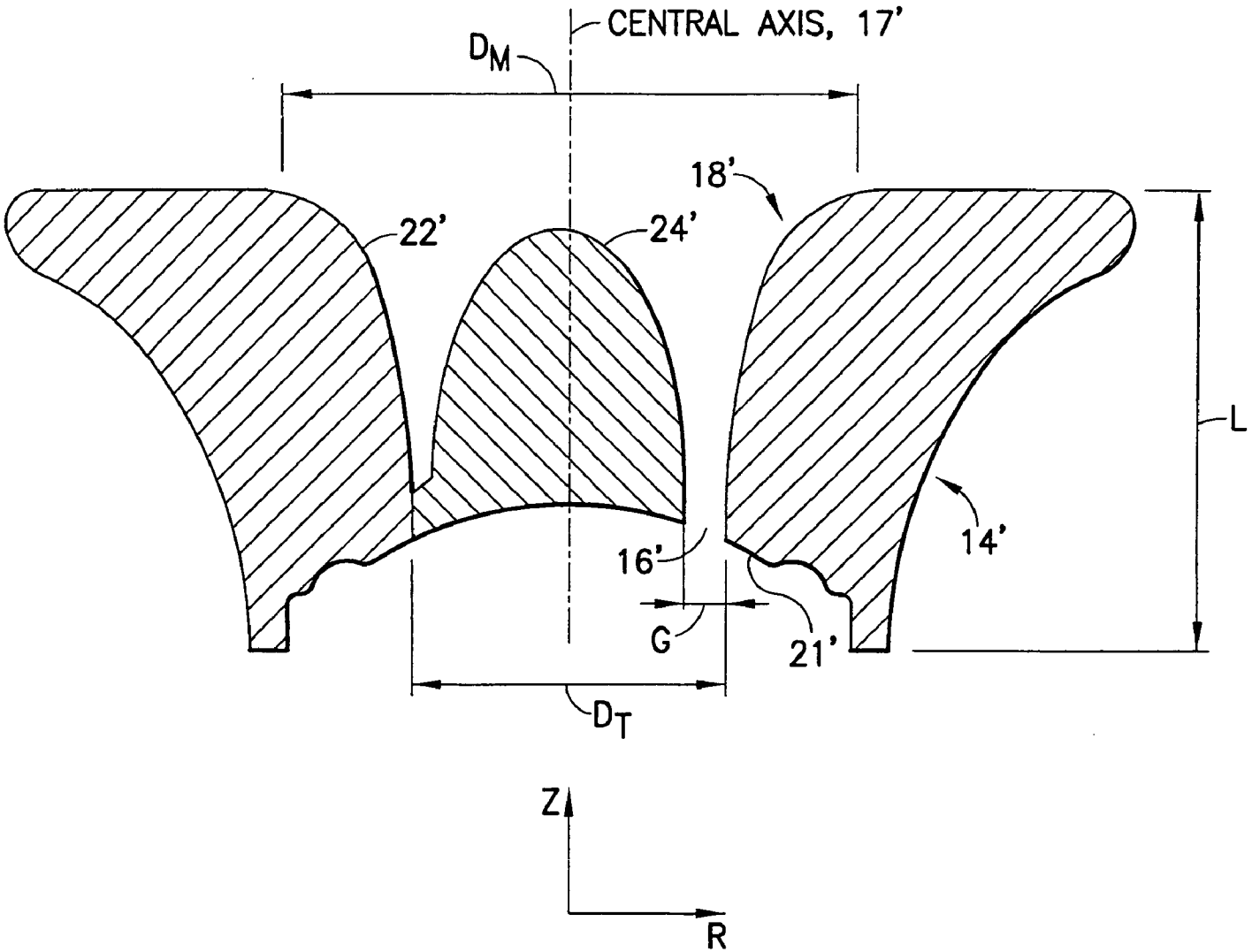
FIG. 3 is a cross-sectional schematic of an exemplary horn waveguide suitable for use in the audio speaker device of FIG. 1A.

FIG. 3 is a cross-section of an exemplary horn 14' suitable for use in the audio speaker system of FIG. 1A. The horn 14' includes a dome-shaped recess 21' shaped to match the dome-shaped diaphragm surface of the speaker driver 12. The recess 21' leads to the throat 16' of an axi-symmetrical waveguide surface 22'. An in-line phase plug 24' is disposed adjacent the throat 16'. The waveguide surface 22' is a tractroid surface which is defined by revolving a tractrix surface around the central axis 17'. This tractroid surface can be represented by the following parametric equations (in Cartesian space):

$$x=\sec h(u)\times\cos(v)$$

$$y=\sec h(u)\times\sin(v)$$

$$z=(u)-\tan h(u)$$

where the z-axis corresponds to the central axis, and the x and y axes are orthogonal to the z-axis as shown.

Figure 7A:
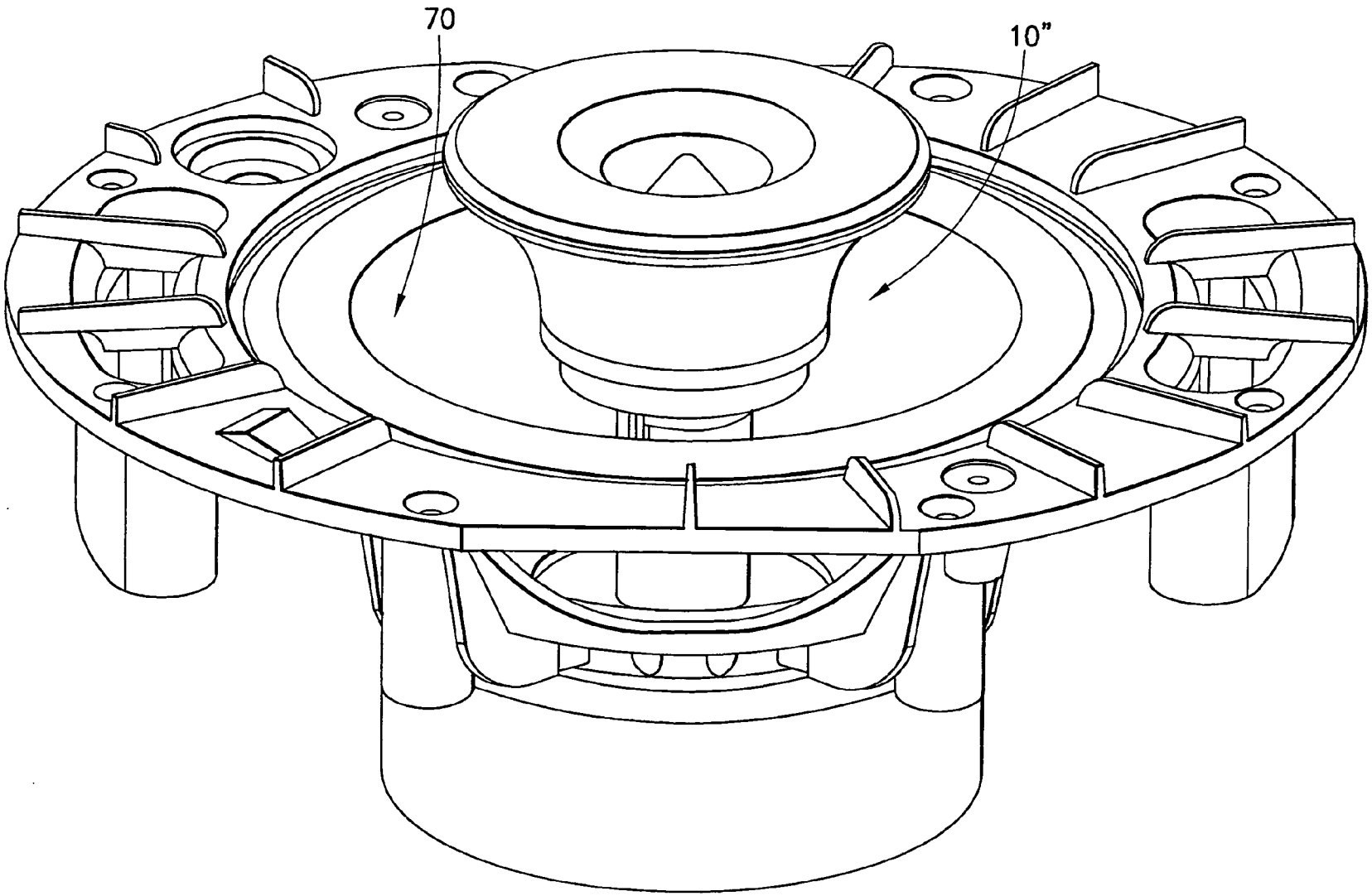
FIG. 7A illustrates an exemplary multi-element speaker system including the horn-loaded speaker device of FIG. 3 mounted co-axially inside a woofer device.
Figure 7B:
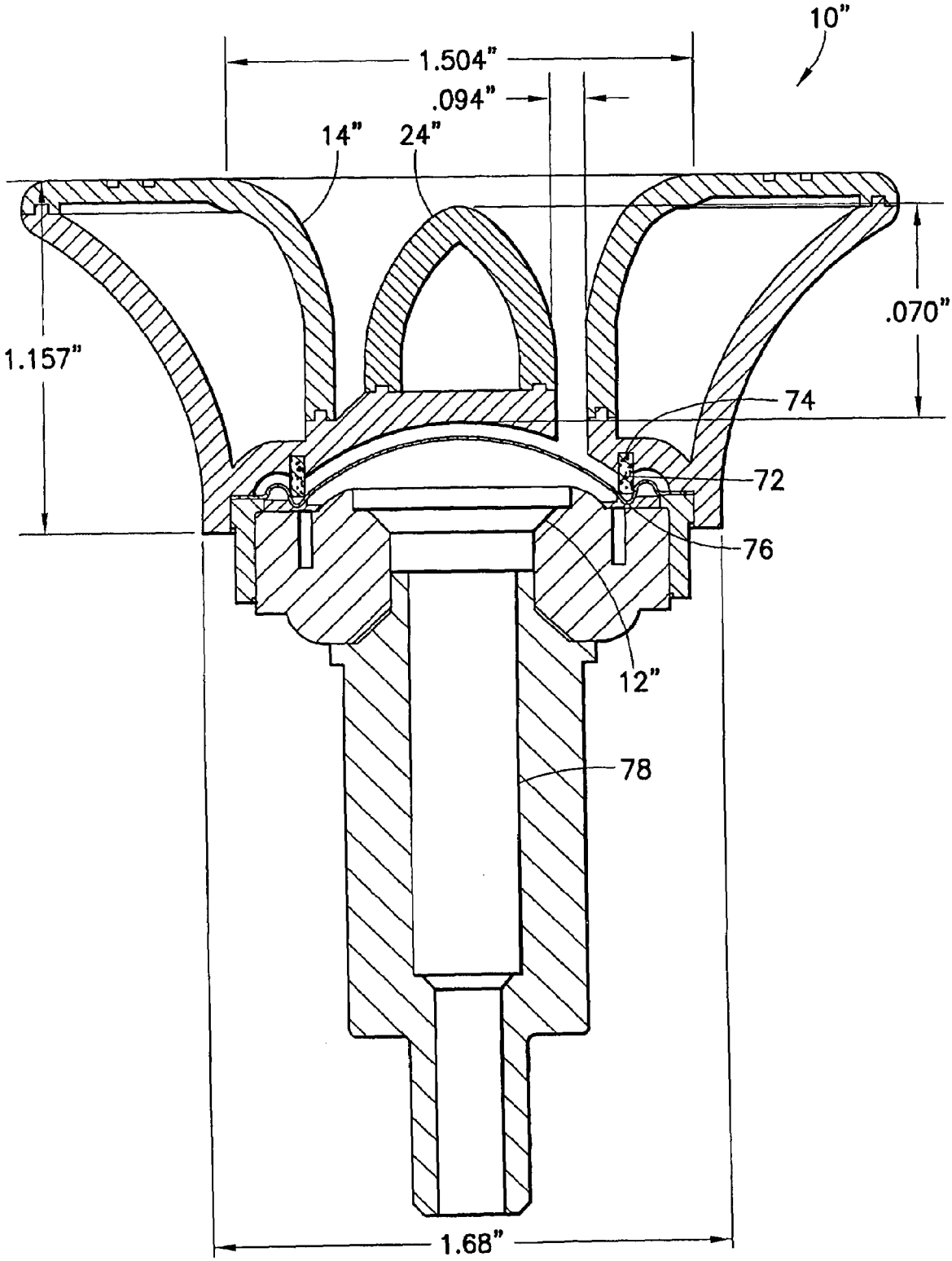
FIG. 7B is a cross-sectional view illustrating the horn-loaded speaker device of FIG. 7A in accordance with the present invention.

The dimensions of the horn (which are shown in FIG. 7B) provide a throat 16' that is approximately 0.192 square inches, which is governed by the phase plug diameter on the order of 0.638 inches and a throat diameter $D_T$ on the order of 0.825 inches. The area of the mouth 18' is approximately 1.777 square inches, which is governed by the mouth diameter $D_M$ on the order of 1.504 inches. The horn length L is approximately 1.125 inches. These parameters provide a frequency response between 800 Hz and 11 kHz, which encompasses a substantial part of the frequency range (e.g., between 800 Hz and 15 kHz) supported by the speaker driver 12.

The waveguide surface 22' of the horn 14' provides uniform polar dispersion of sound at wide dispersion angles over an extended frequency range between 800 Hz and 11 kHz as described above with respect to the beamwidth curve of FIG. 2B. In other words, the sound waves of a particular frequency within the extended frequency band (e.g., between 800 Hz and 11 kHz) are uniformly dispersed in both the x-direction and y-direction). Preferably, the extended frequency band (e.g., between 800 Hz and 11 kHz) encompasses a substantial part of the frequency range supported by the speaker driver 12.

Figure 4A:
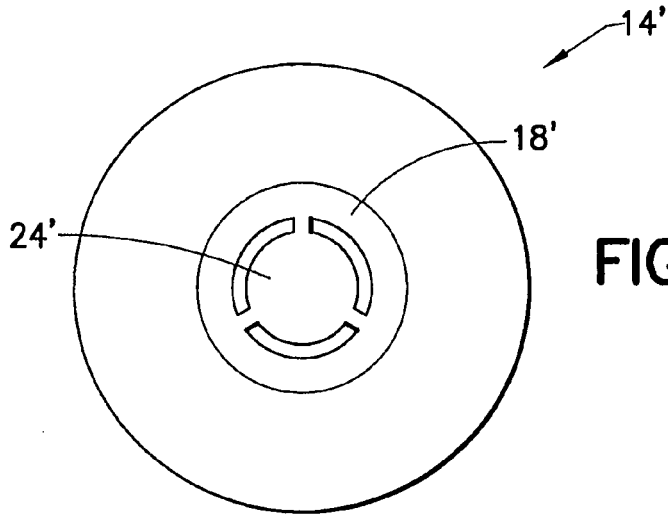
FIGS. 4A, 4B and 4C are different views of a solid model of the horn waveguide of FIG. 3.
Figure 4B:
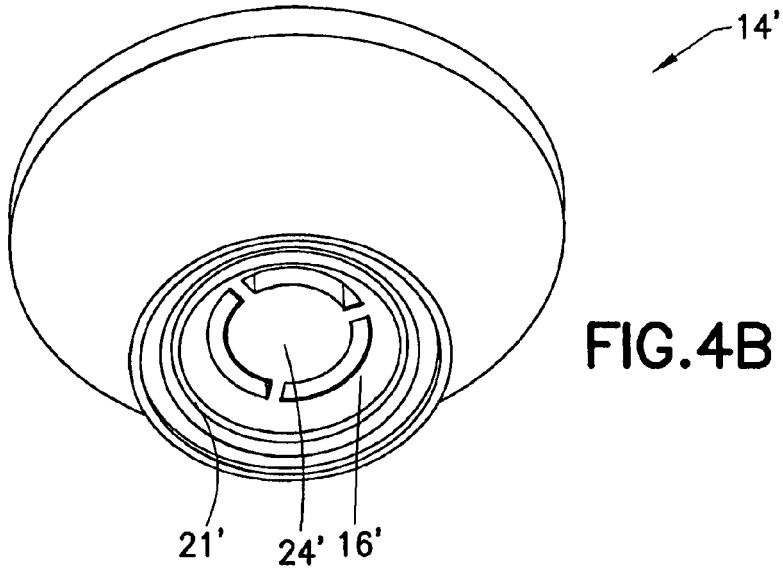
Figure 4C:
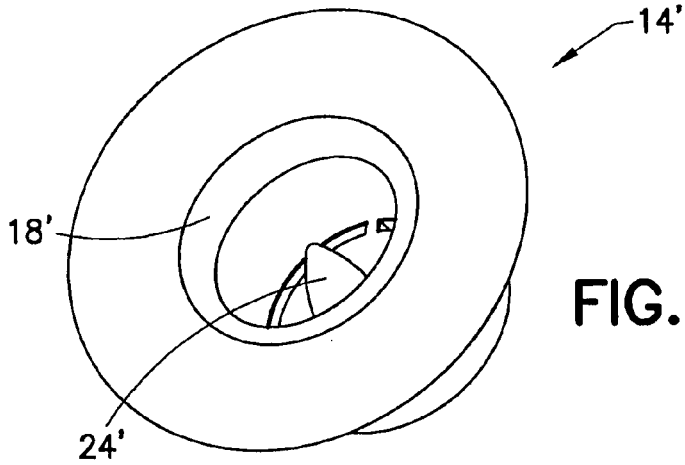

Different views of a solid model of the horn 14' are shown in FIGS. 4A, 4B and 4C.

Figure 5A:
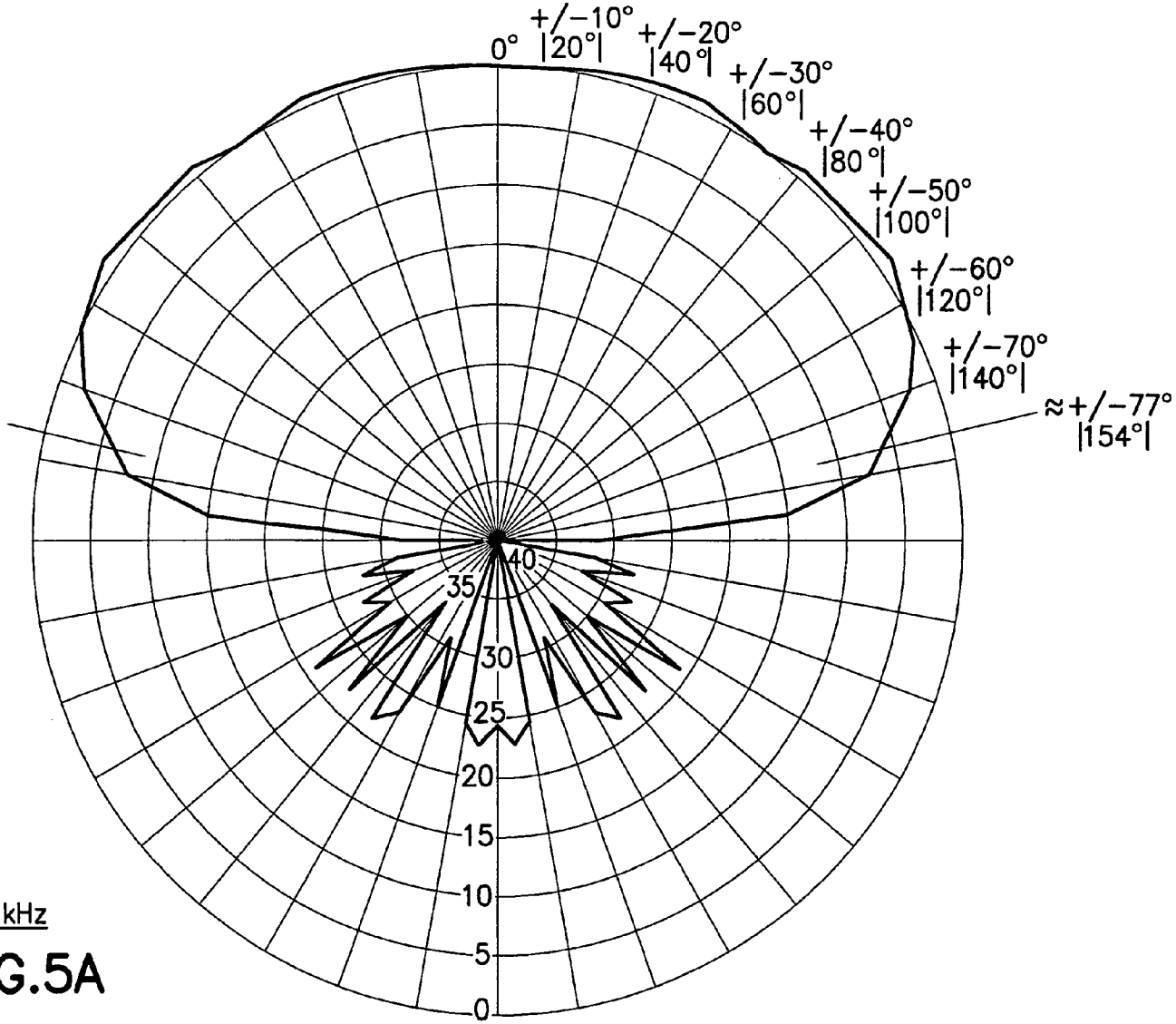
FIGS. 5A through 5G are two-dimensional polar plots that describe the dispersion characteristics of the horn waveguide of FIG. 3 for particular frequencies of sound.
Figure 5B:
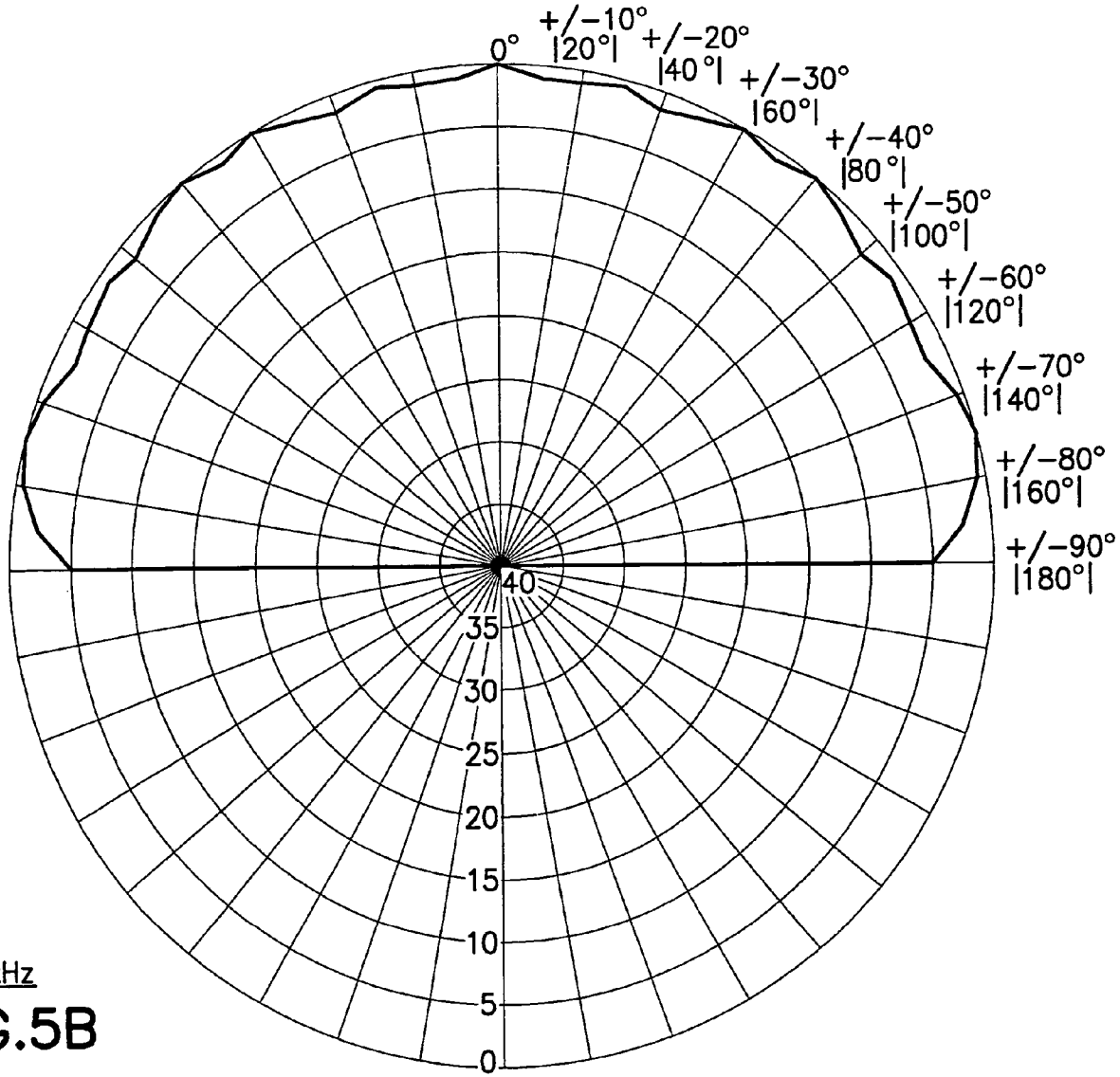
Figure 5C:
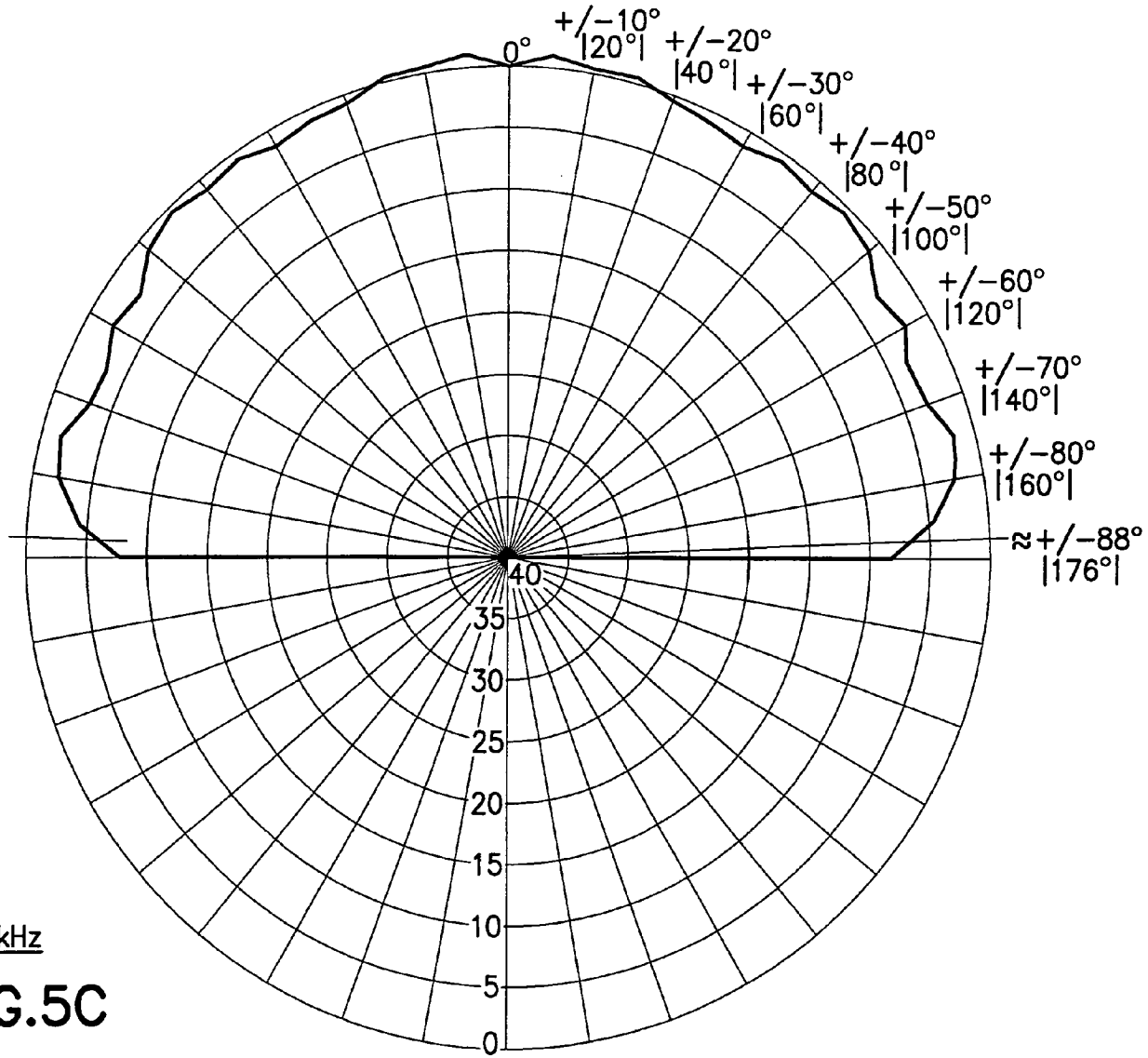
Figure 5D:
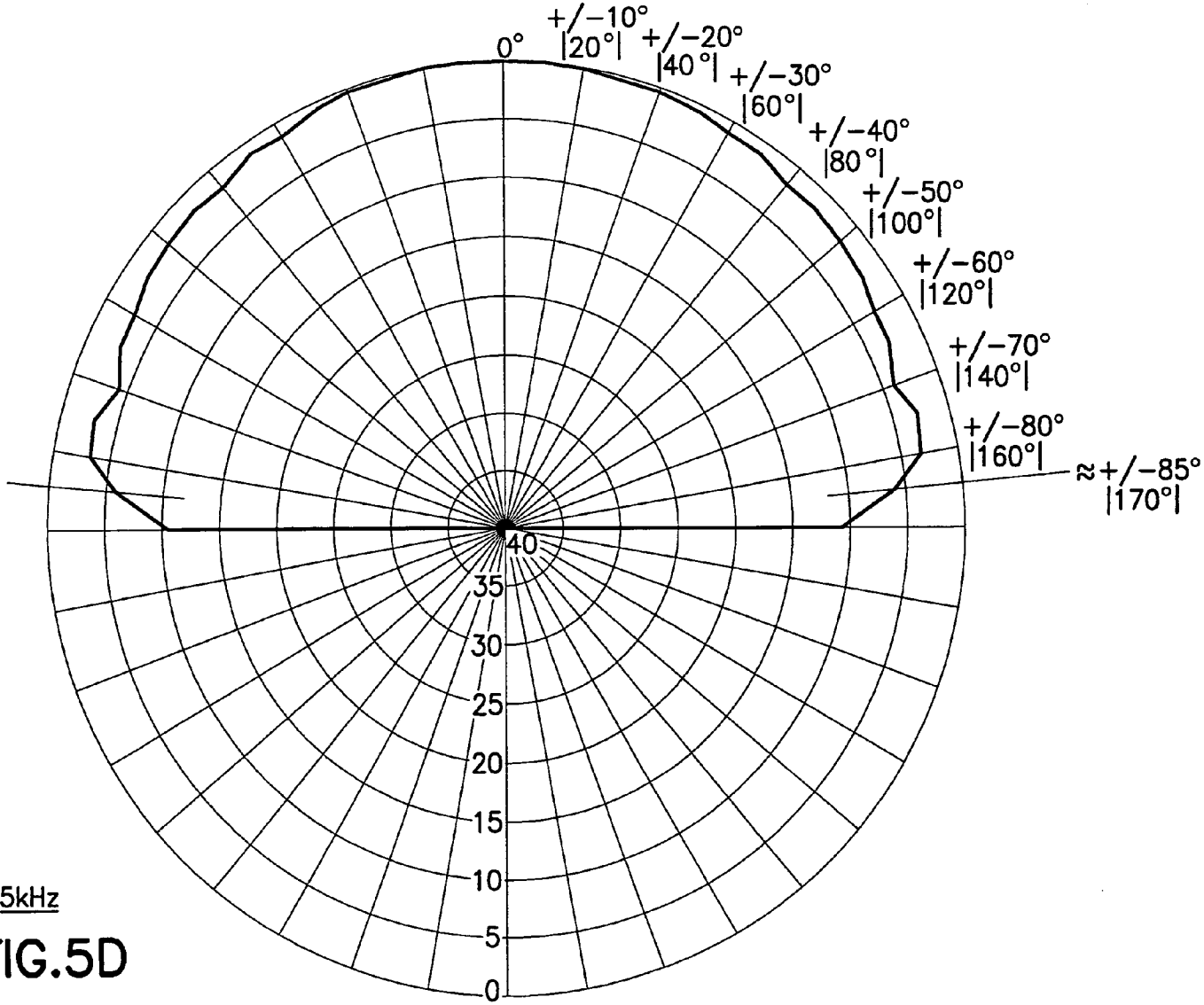
Figure 5E:
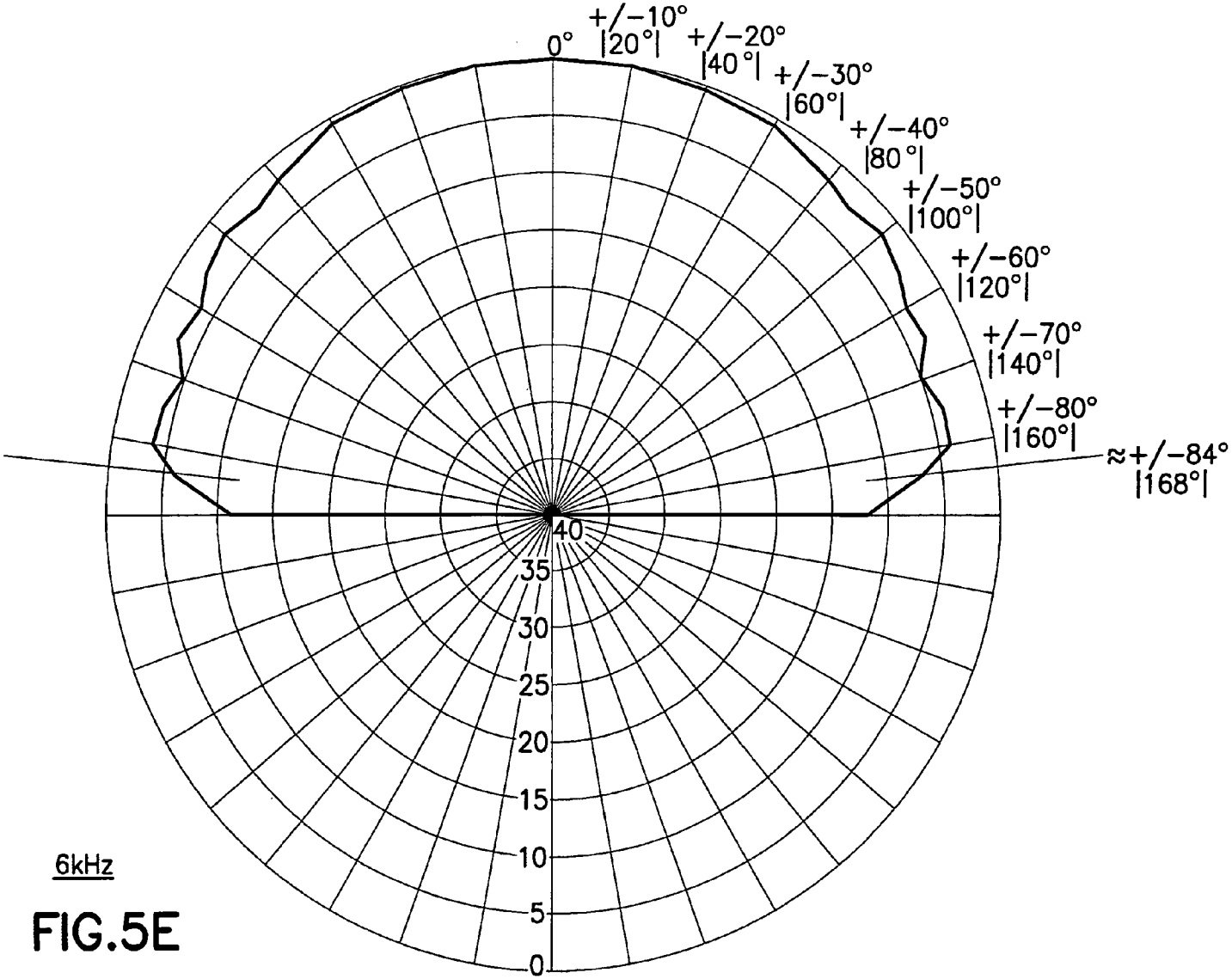
Figure 5F:
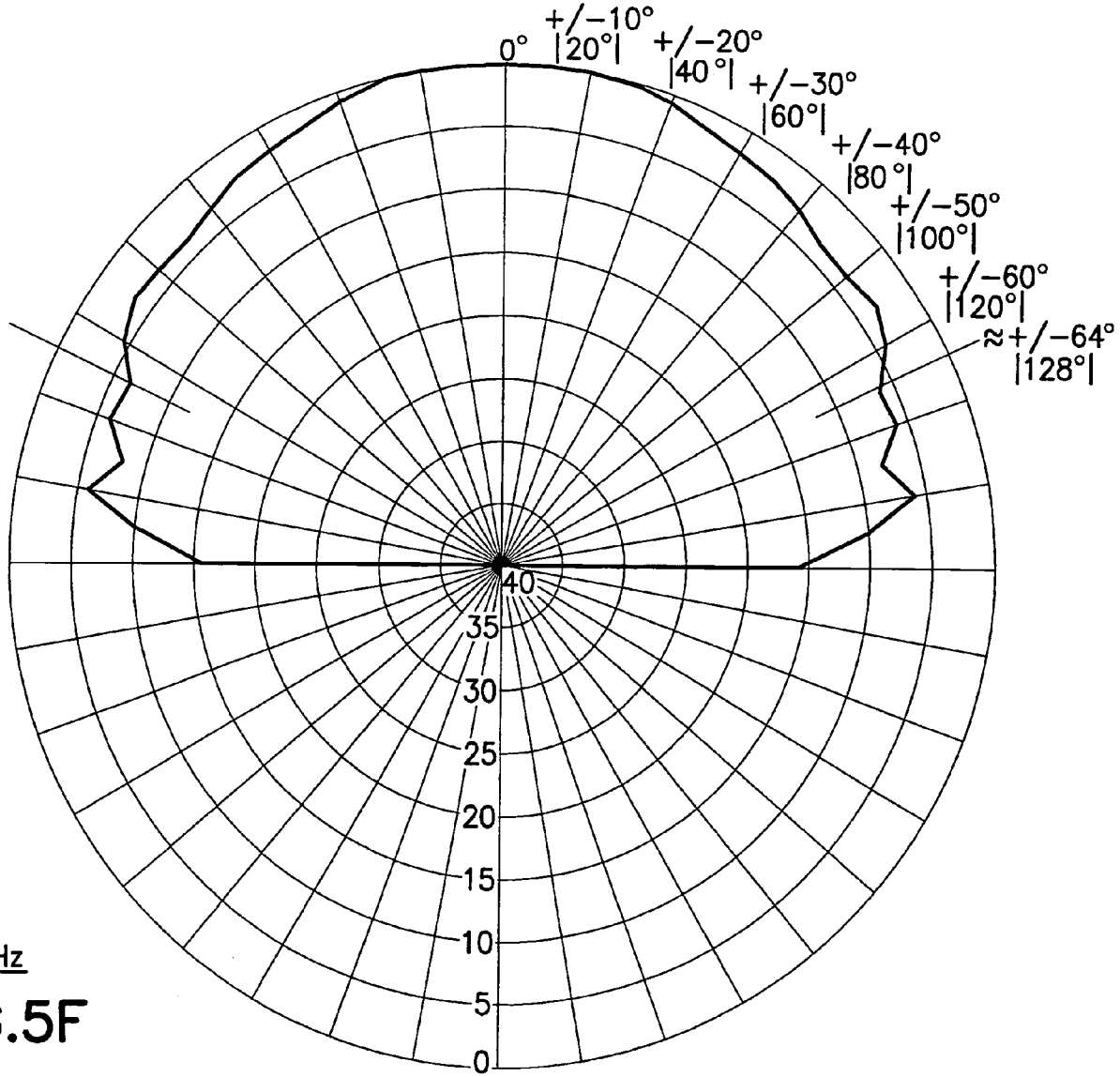
Figure 5G:
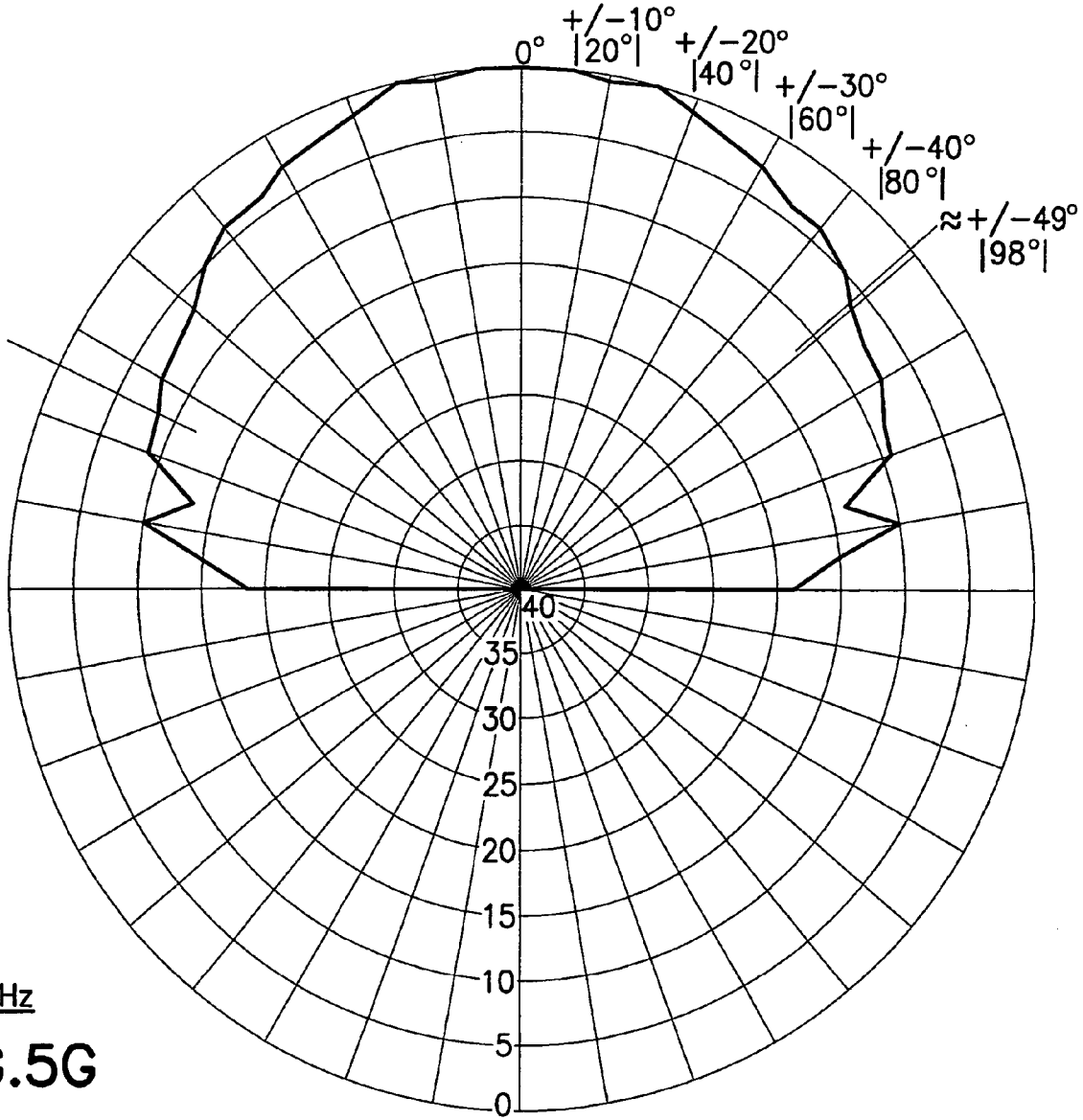
Figure 6:
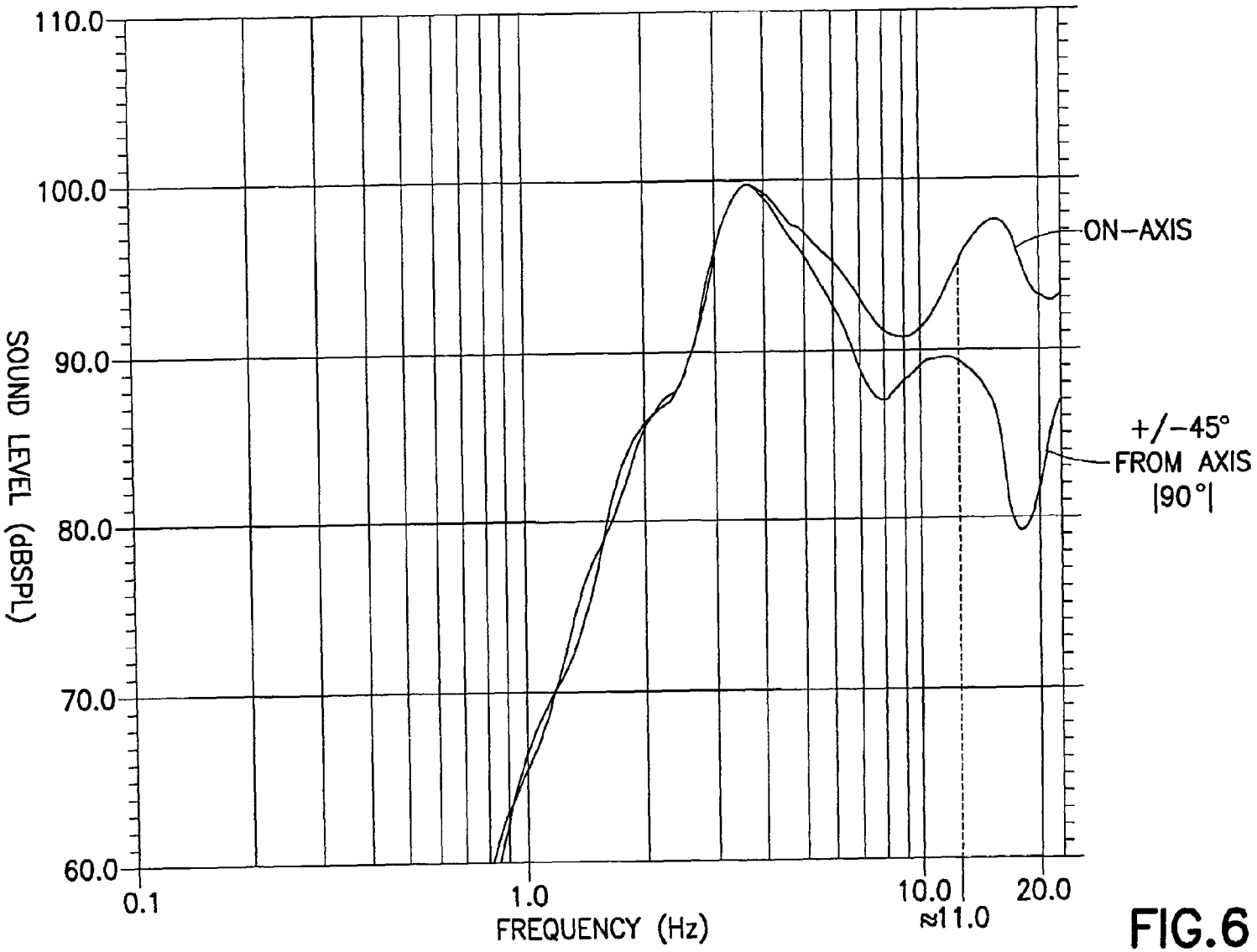
FIG. 6 is a plot of the on-axis sound levels and the 90° sound levels (+/−45° from the central axis) emitted from the waveguide horn of FIG. 3 over a range of sound frequencies.

FIGS. 5A through 5G and 6 are plots that describe the dispersion characteristics of the horn 14' for particular frequencies of sound. FIG. 5A is a two-dimensional polar plot depicting the dispersion characteristics of the horn 14' for a 1 kHz tone. It shows a dispersion pattern with a dispersion angle of approximately 154° (+/−77°) for the 1 kHz tone. FIG. 5B is a two-dimensional polar plot depicting the dispersion characteristics of the horn 14' for a 3 kHz tone. It shows a dispersion pattern with a dispersion angle of approximately 180° (+/−90°) for the 3 kHz tone. FIG. 5C is a two-dimensional polar plot depicting the dispersion characteristics of the horn 14' for a 4 kHz tone. It shows a dispersion pattern with a dispersion angle of approximately 176° (+/−88°) for the 4 kHz tone. FIG. 5D is a two-dimensional polar plot depicting the dispersion characteristics of the horn 14' for a 5 kHz tone. It shows a dispersion pattern with a dispersion angle of approximately 170° (+/−85°) for the 5 kHz tone. FIG. 5E is a two-dimensional polar plot depicting the dispersion characteristics of the horn 14' for a 6 kHz tone. It shows a dispersion pattern with a dispersion angle of approximately 168° (+/−84°) for the 6 kHz tone. FIG. 5F is a two-dimensional polar plot depicting the dispersion characteristics of the horn 14' for an 8 kHz tone. It shows a dispersion pattern with a dispersion angle of approximately 128° (+/−64°) for the 8 kHz tone. FIG. 5G is a two-dimensional polar plot depicting the dispersion characteristics of the horn 14' for a 10 kHz tone. It shows a dispersion pattern with a dispersion angle of approximately 98° (+/−49°) for the 10 kHz tone. FIG. 6 is a plot of the on-axis sound levels and the 90° sound levels (+/−45° from the central axis) emitted from the horn 14' over a range of sound frequencies. It shows wide dispersion (which is provided by less than a 6 dB difference between the on-axis sound levels and the 90° sound levels) for frequencies between 1 kHz and 11 KHz, and narrowing dispersion (which is provided by greater than a 6 dB difference between the on-axis sound levels and the 90° sound levels) for frequencies above 11 kHz to 20 kHz. Together, these plots illustrate that the waveguide surface 22' of the horn 14' provides a wide dispersion angle over a large frequency range between 1 kHz and 11 kHz of sound.

In the preferred embodiment, the speaker driver 12 is rear-vented to enable low frequency components to be emitted from the backside of the speaker driver 12 into a rear chamber 26 as shown in FIG. 1A. In this configuration, the rear chamber 26 is preferably lined with sound absorbing/dampening material that dissipates the low frequency energy emitted from the backside of the speaker driver 12. This feature enables high quality reproduction of low frequency sound components by the speaker driver 12.

The horn-loaded speaker device of FIG. 1A may be integrated into a multi-element speaker system. An exemplary multi-element speaker system is shown in FIG. 7A wherein the horn-loaded speaker device 10" of the present invention is disposed coaxially with a woofer device 70 that reproduces low frequency sound components. In this configuration, the low frequency components reproduced by the horn-loaded speaker device 10" provides smooth audible overlap at the crossover frequency of the woofer device 70, and the rear side of the horn-loaded speaker device 10" acts as diffuser for the low frequency woofer device 70.

As shown in the cross-section of FIG. 7B, an annular gasket 72 (which preferably realized from closed-cell foam or some other compliant material that is acoustically absorbent) is disposed outside the throat of the horn 14" in opposing annular grooves 74, 76 in the horn 14" and in the roll suspension of the sound reproducing membrane of the speaker driver 12" as shown. The gasket 72 minimizes the volume of the compression chamber that the sound reproducing membrane is compressing, thus leading to less frequency cancellation (which empirically leads to more linear frequency response when measured under normal conditions at a 1 meter distance). Moreover, the speaker driver 12" of the horn-loaded speaker 10" preferably employs a ring-shaped neodymium magnet. In this configuration, the passageway through the ring-shaped magnet allows the speaker driver 12" to be rear-vented into the hollow mounting stem 78 that supports the horn-loaded speaker device 10", which increases the rear acoustic volume behind the sound reproducing membrane of the speaker driver 12" to provide improved low frequency response. The low frequency components reproduced by the rear-vented horn-loaded speaker device 10" also provides a smooth audible overlap at the crossover frequency of the woofer device 70.

There have been described and illustrated herein several embodiments horn-loaded audio speaker systems that provide improved frequency response (and more particularly wide dispersion characteristics over an extended frequency range). While particular embodiments of the invention have been described, it is not intended that the invention be limited thereto, as it is intended that the invention be as broad in scope as the art will allow and that the specification be read likewise. Thus, while particular sizes, shapes and materials have been disclosed for various components of the horn-loaded speaker system, it will be appreciated that other sizes, shapes and materials can be used as well. In addition, while particular types of waveguide surfaces (e.g., exponential and tractroid) have been disclosed, it will be understood that other forms of axi-symmetrical surfaces can be used. Moreover, the omnidirectional wide dispersion angle characteristics of the horn-loaded speaker device may be adapted to extend (or to shorten) the top end of the frequency range (e.g., between 1 kHz and 11 kHz) described herein up to 20 kHz. Similarly, the omnidirectional wide dispersion angle characteristics of the horn-loaded speaker device may be adapted to extend (or to shorten) the bottom end of the frequency range (e.g., between 1 kHz and 11 kHz) described herein. It will therefore be appreciated by those skilled in the art that yet other modifications could be made to the provided invention without deviating from its spirit and scope as claimed.

What is claimed is:

1. An audio speaker system comprising:

a speaker driver for reproducing sound; and a horn having a throat and a mouth with an axis-symmetrical waveguide surface extending therebetween, said throat disposed substantially adjacent said speaker driver, said waveguide surface having a circular cross-section along its entire length between said throat and said mouth, and said waveguide surface dispersing sound reproduced by the speaker driver within the predetermined frequency range at a dispersion angle greater than 90 degrees.

2. An audio speaker system according to claim 1, wherein:

said waveguide surface provides uniform polar dispersion at dispersion angles greater than 90 degrees for sound within the predetermined frequency range.

3. An audio speaker system according to claim 1, wherein:

the predetermined frequency range includes a frequency band between 2 kHz and 11 kHz.

4. An audio speaker system according to claim 1, wherein:

the predetermined frequency range includes a frequency band between 800 Hz and 11 kHz.

5. An audio speaker system according to claim 1, wherein:

said waveguide surface has a radial dimension that increases curvilinearly from said throat to said mouth.

6. An audio speaker system according to claim 5, wherein:

a portion of said waveguide surface defines a tractroid surface.

7. An audio speaker system according to claim 5, wherein:

a portion of said waveguide surface has length that is exponentially related to the area of its mouth.

8. An audio speaker system according to claim 5, wherein:

a portion of said waveguide surface is curvilinear with a smooth flare rate.

9. An audio speaker system according to claim 5, wherein:

length of said waveguide surface is approximately 1.125 inches.

10. An audio speaker system according to claim 1, wherein:

area of said throat is approximately 0.192 inches.

11. An audio speaker system according to claim 1, wherein:

area of said mouth is approximately 1.777 square inches.

12. An audio speaker system according to claim 1, wherein:

said speaker driver includes a radiating dome-shaped surface.

13. An audio speaker system according to claim 1, wherein:

said speaker driver is rear-vented into a rear chamber that dissipates low frequency sound components.

14. An audio speaker system according to claim 1, further comprising:

an annular gasket disposed in annular grooves outside a throat area of said horn.

15. An audio speaker system according to claim 14, wherein:

said annular gasket is formed from a foam material.

16. An audio speaker system according to claim 1, wherein:

said speaker driver comprises a ring-shaped neodymium magnet.

17. An audio speaker system according to claim 1, wherein:

said speaker driver and horn are disposed coaxially with a low frequency speaker to thereby realize an integrated multi-element system.

18. An audio speaker system according to claim 1, further comprising:

cross-over circuitry, operably coupled to said speaker driver, that provides high pass filtering with a cutoff frequency corresponding to the predetermined frequency range of.

19. An audio speaker system comprising:

a speaker driver for reproducing sound and a horn having a throat and a mouth with an axi-symmetrical waveguide surface extending therebetween, said throat disposed substantially adjacent said speaker driver, said waveguide surface having a circular cross-section along its entire length between said throat and said mouth, said waveguide surface being curvilinear with a smooth flare rate, said waveguide surface dispersing sound reproduced by the speaker driver within predetermined frequency range at a dispersion angle greater than 90 degrees.

20. An audio speaker system according to claim 19, wherein:

said waveguide surface provides uniform polar dispersion at dispersion angles greater than 90 degrees for sound within the extended frequency range.

21. An audio speaker system according to claim 19, wherein:

the predetermined frequency range includes a frequency band between 2 kHz and 11 kHz.

22. An audio speaker system according to claim 19, wherein:

the predetermined frequency range includes a frequency band between 800 Hz and 11 kHz.

23. An audio speaker system according to claim 19, wherein:

said speaker driver includes a radiating dome-shaped surface.

24. An audio speaker system according to claim 19, wherein:

said speaker driver is rear-vented into a rear chamber that dissipates low frequency sound components.

25. An audio speaker system according to claim 19, further comprising:

an annular gasket disposed in annular grooves outside a throat area of said horn.

26. An audio speaker system according to claim 25, wherein:

said annular gasket is formed from a foam material.

27. An audio speaker system according to claim 19, wherein:

said speaker driver comprises a ring-shaped neodymium magnet.

28. An audio speaker system according to claim 19, wherein:

said speaker driver and horn are disposed coaxially with a low frequency speaker to thereby realize an integrated multi-element system.

29. An audio speaker system according to claim 19 further comprising:

cross-over circuitry, operably coupled to said speaker driver, that provides high pass filtering with a cutoff frequency corresponding to the predetermined frequency range.

30. An audio speaker system according to claim 19, wherein:

the predetermined frequency range includes a frequency band between 8 kHz and 11 kHz.

31. An audio speaker system according to claim 1, wherein:

the predetermined frequency range includes a frequency band between 8 kHz and 11 kHz.

* * * * *